US008602097B2

(12) United States Patent
Hepburn et al.

(10) Patent No.: US 8,602,097 B2
(45) Date of Patent: Dec. 10, 2013

(54) WELL ASSEMBLY WITH A COMPOSITE FIBER SLEEVE FOR AN OPENING

(75) Inventors: Neil Hepburn, Newcastle Upon Tyne (GB); Epen Dahl, Stavanger (NO); William Shaun Renshaw, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 369 days.

(21) Appl. No.: 12/726,717

(22) Filed: Mar. 18, 2010

(65) Prior Publication Data

US 2011/0226467 A1 Sep. 22, 2011

(51) Int. Cl.
*E21B 17/00* (2006.01)
*E21B 7/06* (2006.01)

(52) U.S. Cl.
USPC ..... 166/242.1; 166/50; 166/117.5; 175/61

(58) Field of Classification Search
USPC ..... 166/50, 117.5, 242.1, 187; 175/61, 230
See application file for complete search history.

(56) References Cited

U.S. PATENT DOCUMENTS

| | | | | |
|---|---|---|---|---|
| 2,994,378 | A * | 8/1961 | Reistle, Jr. | 166/72 |
| 3,926,254 | A * | 12/1975 | Evans et al. | 166/106 |
| 4,890,675 | A | 1/1990 | Dew | |
| 5,297,640 | A | 3/1994 | Jones | |
| 5,340,626 | A * | 8/1994 | Head | 277/334 |
| 5,564,503 | A | 10/1996 | Longbottom et al. | |
| 5,579,829 | A | 12/1996 | Comeau et al. | |
| 5,615,740 | A | 4/1997 | Comeau et al. | |
| 5,884,698 | A * | 3/1999 | Hughes et al. | 166/117.6 |
| 6,012,527 | A | 1/2000 | Nitis et al. | |
| 6,041,855 | A * | 3/2000 | Nistor | 166/50 |
| 6,206,111 | B1 | 3/2001 | Nistor | |
| 6,213,228 | B1 | 4/2001 | Saxman | |
| 6,332,498 | B1 * | 12/2001 | George | 166/50 |
| 6,386,287 | B2 | 5/2002 | George | |
| 6,467,557 | B1 * | 10/2002 | Krueger et al. | 175/45 |
| 6,811,189 | B1 | 11/2004 | DeLange et al. | |
| 6,868,909 | B2 | 3/2005 | Murray | |
| 6,913,082 | B2 | 7/2005 | McGlothen et al. | |

(Continued)

FOREIGN PATENT DOCUMENTS

| | | |
|---|---|---|
| WO | WO98/09053 | 3/1998 |
| WO | WO2009/142914 | 11/2009 |

OTHER PUBLICATIONS

Thiele, Jr., et al., "Comparative Machinability of Brasses, Steels and Aluminum Allows: CDA's Universal Machinability Index," SAE Technical Paper 900365, Feb. 1990 (ten pages).

(Continued)

*Primary Examiner* — Shane Bomar
*Assistant Examiner* — Robert E Fuller
(74) *Attorney, Agent, or Firm* — Kilpatrick Townsend & Stockton LLP

(57) ABSTRACT

Assemblies that can be disposed in a subterranean bore. An assembly can include a body with an opening in a wall of the body. A sleeve can be disposed exterior to the body at the opening. The sleeve can be made from material such as carbon fiber that can withstand at least some pressures and forces present in the subterranean environment and reduce a diameter of the body and sleeve. The assembly may also include an inner sleeve and/or an inner string that can isolate the sleeve from certain pressures and forces.

19 Claims, 5 Drawing Sheets

(56) References Cited

U.S. PATENT DOCUMENTS

| | | | | |
|---|---|---|---|---|
| 7,104,324 | B2 | 9/2006 | Wetzel et al. | |
| 7,213,652 | B2 | 5/2007 | Hepburn et al. | |
| 7,225,875 | B2 | 6/2007 | Steele et al. | |
| 2006/0289156 | A1 | 12/2006 | Murray | |
| 2009/0045974 | A1 | 2/2009 | Patel | |
| 2009/0272537 | A1 | 11/2009 | Alikin et al. | |
| 2009/0288829 | A1 | 11/2009 | Parlin | |
| 2009/0288833 | A1* | 11/2009 | Graham et al. | 166/306 |
| 2010/0051269 | A1 | 3/2010 | Smithson et al. | |

OTHER PUBLICATIONS

Hilbert, et al., "Evaluating Pressure Integrity of Polymer Ring Seals for Threaded Connections in HP/HT Wells and Expandable Casing," 2004, IADC/SPE Drilling Conference (twelve Pages).
U.S. Appl. No. 12/700,448, filed Feb. 4, 2010 (thirty-seven pages).
U.S. Appl. No. 12/750,215, filed Mar. 30, 2010 (twenty-seven pages).
U.S. Appl. No. 12/751,343, filed Mar. 31, 2010 (thirty-two pages).
U.S. Appl. No. 12/789,822, filed May 28, 2010 (fifty-three pages).
PCT/US2011/023956, International Search Report and Written Opinion mailed Sep. 7, 2011 (8 pages).

* cited by examiner

WELL ASSEMBLY WITH A COMPOSITE FIBER SLEEVE FOR AN OPENING

TECHNICAL FIELD OF THE INVENTION

The present invention relates generally to an assembly for subterranean fluid production and, more particularly (although not necessarily exclusively), to an assembly that includes a composite fiber sleeve exterior to an opening of an assembly body.

BACKGROUND

Hydrocarbons can be produced through a wellbore traversing a subterranean formation. The wellbore may be relatively complex. For example, the wellbore can include multilateral wellbores and/or sidetrack wellbores. Multilateral wellbores include one or more lateral wellbores extending from a parent (or main) wellbore. A sidetrack wellbore is a wellbore that is diverted from a first general direction to a second general direction. A sidetrack wellbore can include a main wellbore in a first direction and a secondary wellbore diverted from the main wellbore and in a second general direction. A multilateral wellbore can include a window to allow lateral wellbores to be formed. A sidetrack wellbore can include a window to allow the wellbore to be diverted to the second general direction.

A window may be an opening in a sidewall portion of a casing string. The window can be pre-milled by being created before the casing string is positioned in the wellbore. Casing strings with pre-milled windows can be used to reduce or eliminate debris. Aluminum outer sleeves can be positioned outside of the pre-milled windows to prevent debris from entering the inner diameter of the casing string through the pre-milled windows during positioning of the casing string in the wellbore, or otherwise. After a casing string is positioned in the wellbore, an aluminum outer sleeve can be milled to allow the branch wellbore to be drilled.

Before creating branch wellbores, the parent wellbore can be completed. Completion methods can include fracturing the formation in proximity to a production zone of the parent wellbore by pumping fracturing fluids into the well at high pressure to stimulate hydrocarbon production from the formation. Other completion tasks can include the introduction of high pressure. Casing strings can also experience high pressure in the wellbore independent of the high pressure introduced into the wellbore. Aluminum or similar types of outer sleeves may need to be relatively thick to retain a general configuration and to withstand burst and collapse pressures.

Thick aluminum sleeves increase the outer diameter of casing strings. In some applications, the outer diameter may be increased by one or more inches. Such an increase in the outer diameter can be unacceptable in some situations.

In some applications, the outer sleeves are glass fiber and a steel inner sleeve is positioned inside the casing string to provide support. The steel inner sleeve, however, needs to be retrieved to complete the wellbore, or otherwise to form the branch wellbore. Retrieving the steel inner sleeve can require a separate run and can be costly.

Therefore, an assembly is desirable that can provide sufficient support for a pre-milled casing string window and avoid requiring a substantial increase in the outer diameter of the casing string. Assemblies are also desirable that withstand burst and collapse pressures and avoid substantially increasing outer diameters of casing strings. Assemblies are also desirable that do not require a separate run to retrieve an inner sleeve.

SUMMARY

Certain embodiments of the present invention are directed to an assembly that includes a body and a sleeve disposed exterior to the body at an opening of a wall of the body. The sleeve can be made from a material, such as carbon fiber, that can withstand at least some pressures and forces present in the subterranean environment and to reduce a diameter of the body and sleeve. The assembly may also include an inner sleeve and/or an inner string that can isolate the sleeve from certain pressures and forces.

In one aspect, an assembly that can be disposed in a bore is provided. The assembly includes a body, a sleeve, and a component. The body includes a wall with an opening in a portion of the wall. The sleeve is disposed exterior to the body. Part of the sleeve is adjacent to the opening and is made from at least one fiber material and from a support material. The sleeve can cooperate with the body to provide a pressure seal between an inner area of the body and an environment exterior to the body. The component can carry torque from one end of the assembly to another end of the assembly.

In at least one embodiment, the component is a string in the inner area of the body. The string can carry torque from the first end to the second end of the assembly.

In at least one embodiment, the component is a second sleeve and a fluid. The second sleeve is in the inner area of the body and is coupled to the body. The fluid is disposed between part of the second sleeve and part of the sleeve.

In at least one embodiment, the fluid can cooperate with the sleeve and the second sleeve to prevent bursting by the sleeve.

In at least one embodiment, the fluid is an incompressible fluid.

In at least one embodiment, the fiber materials include at least one of carbon fiber, fiberglass, para-aramid synthetic fiber, silicon carbine, or carbon nanotubes.

In at least one embodiment, the support material includes an epoxy.

In at least one embodiment, part of the sleeve adjacent to the opening can be drilled after being positioned in the wellbore.

In another aspect, an assembly is provided that can be disposed in a bore. The assembly includes a body, a sleeve, and a string. The body includes a wall that has an opening in a portion of the wall. The sleeve is disposed exterior to the body. Part of the sleeve is adjacent to the opening and is made from at least one fiber material. The sleeve can cooperate with the body to provide a pressure seal between an inner area of the body and an environment exterior to the body. The string is disposed in the inner area of the body. The string can carry torque from one end of the assembly to another end of the assembly.

In at least one embodiment, the string is made from at least one of steel, titanium alloy, or aluminum alloy.

In another aspect, an assembly is provided that can be disposed in a bore. The assembly includes a body, a sleeve, a second sleeve, and a fluid. The body includes a wall that has an opening in a portion of the wall. The sleeve is disposed exterior to the body. Part of the sleeve is adjacent to the opening and is made from at least two different fiber materials. The sleeve can cooperate with the body to provide a pressure seal between an inner area of the body and an environment exterior to the body. The second sleeve is in the inner area of the body and is coupled to the body. The fluid is disposed between part of the second sleeve and part of the sleeve.

In at least one embodiment, the second sleeve is coupled to the body by connectors.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
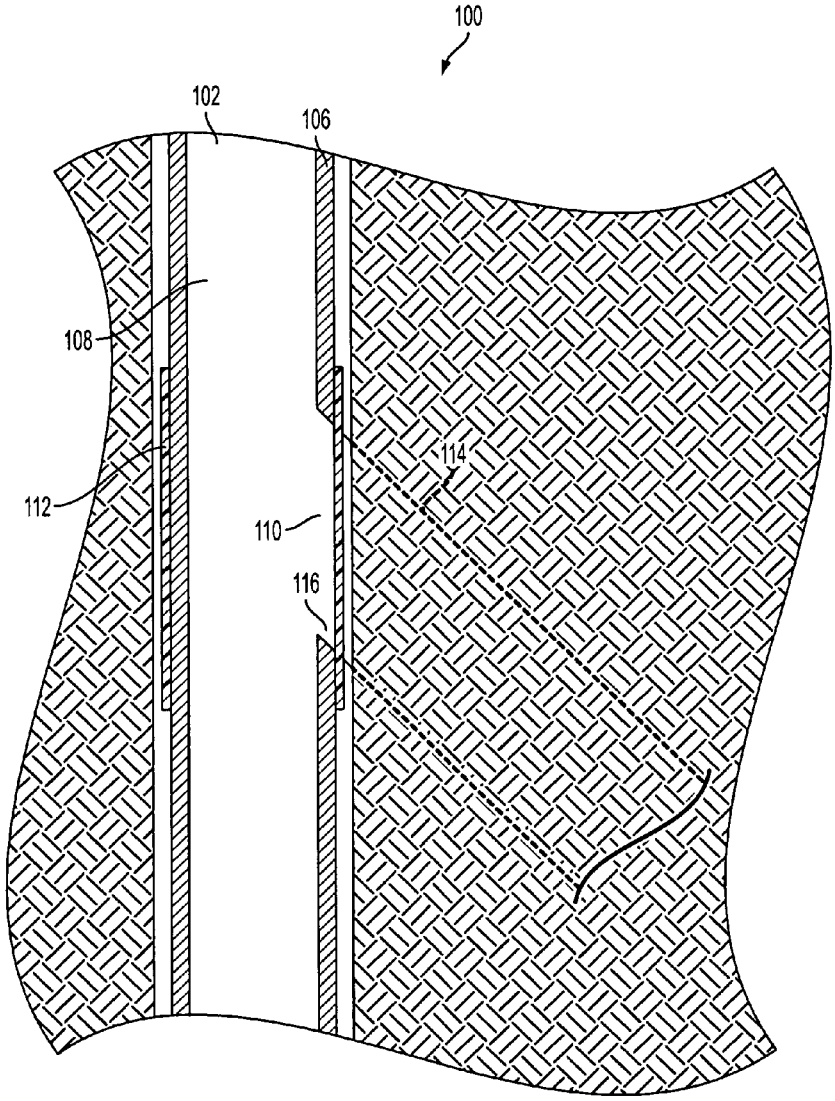
FIG. 1 is a schematic cross-sectional illustration of a well system having an assembly with a sleeve exterior to a pre-milled window according to an embodiment of the present invention.

Certain aspects and embodiments of the present invention relate to assemblies capable of being disposed in a bore, such as a wellbore, of a subterranean formation. An assembly according to some embodiments includes a sleeve exterior to a pre-milled window that is an opening in a wall of a body such as a casing string. The sleeve can cooperate with the casing string to provide a pressure seal between an inner area of the body and an environment exterior to the body. The sleeve can be drilled out to form a branch wellbore extending from the wellbore at the pre-milled window.

Sleeves according to certain embodiments of the present invention can be made from material having a high strength-to-density ratio to provide sufficient support and withstand high pressure without substantially increasing outer diameters of casing strings. In some embodiments, a sleeve is made from at least two different fiber materials that can provide support without substantially increasing the diameter of the casing string. The fibers may be aligned or otherwise configured to hold high pressure. In other embodiments, the sleeve is made from at least one type of fiber material and from a support material, such as an epoxy. An example of a high pressure subterranean wellbore environment is one with a pressure greater than 2500 PSI.

Sleeves can be capable of withstanding burst and collapse pressures, and, in some embodiments, torsion forces if needed. Examples of materials from which sleeves can be made include carbon fiber, fiberglass, para-aramid synthetic fiber (commercially known as Kevlar™), silicon carbide, and carbon nanotubes. These are merely examples. Sleeves according to certain embodiments of the present invention can be made from any material having a relatively high specific strength, which is also known as a strength-to-weight ratio of a material. In some embodiments, sleeves can be drilled out, instead of milled out, to form branch wellbores. This can save time and the number of trips needed to form the branch wellbores.

Assemblies according to some embodiments can include other components in addition to sleeves. For example, an assembly can include a sleeve exterior to a pre-milled window and an inner sleeve that is disposed in an inner area of the casing string. A fluid can be located between the inner sleeve and the portion of the sleeve at the pre-milled window. Pressure from an inner region of the inner sleeve causes a force to be exerted onto the fluid, which may be incompressible fluid such as hydraulic fluid. The force causes the fluid to increase pressure to match pressure in the inner region of the inner sleeve, to eliminate differential pressure on the inner sleeve. The fluid also exerts pressure on the sleeve at the pre-milled window such that the differential pressure on the sleeve is eliminated or reduced. The fluid can also cause the inner sleeve to hold the differential pressure from the environment exterior to the casing string. In some embodiments, the inner sleeve can also carry tensile or compression loads from one end of the assembly to a second end of the assembly. The inner sleeve may also isolate the pre-milled window and sleeve from torsion loads by carrying the torsion loads from one end of the assembly to a second end. The inner sleeve can be milled, drilled, or retrieved prior to or when a branch wellbore is created.

In other embodiments, the assembly includes a sleeve exterior to a pre-milled window and a string that is disposed in an inner area of the casing string. The inner string can isolate the pre-milled window and sleeve from tension and torsion forces by carrying such forces from one end of the assembly to a second end. The inner string may be a permanent component of the assembly disposed in the wellbore, or it can be retrievable after the assembly is positioned. In some embodiments, the inner string is part of a string used to orient windows, to direct milling or with drilling tools.

Various embodiments of the present invention can be used to support a pre-milled window in a parent wellbore prior to a branch wellbore being created through the pre-milled window. A "parent wellbore" is a wellbore from which another wellbore is drilled. It is also referred to as a "main wellbore." A parent or main wellbore does not necessarily extend directly from the earth's surface. For example, it could be a branch wellbore of another parent wellbore.

A "branch wellbore" is a wellbore drilled outwardly from its intersection with a parent wellbore. Examples of branch wellbores include a lateral wellbore and a sidetrack wellbore. A branch wellbore can have another branch wellbore drilled outwardly from it such that the first branch wellbore is a parent wellbore to the second branch wellbore.

These illustrative examples are given to introduce the reader to the general subject matter discussed here and are not intended to limit the scope of the disclosed concepts. The following sections describe various additional embodiments and examples with reference to the drawings in which directional descriptions are used to describe the illustrative embodiments but, like the illustrative embodiments, should not be used to limit the present invention.

FIG. 1 shows a well system 100 with an assembly 108 according to one embodiment of the present invention. The well system 100 includes a parent wellbore 102 that extends through various earth strata. The parent wellbore 102 includes a casing string 106 cemented at a portion of the parent wellbore 102.

The casing string 106 includes the assembly 108 interconnected therewith. The assembly 108 can include an opening 110 that is a pre-milled window. A sleeve 112 can be disposed exterior to the opening 110 and at least part of the casing string 106. For example, part of the sleeve 112 is positioned adjacent to the opening 110. The sleeve 112 can cooperate with the casing string 106 to provide a pressure seal between an inner area of the casing string 106 and an environment exterior to the casing string 106. The assembly 108 can be positioned at a desired location to form a branch wellbore 114 from the parent wellbore 102. The desired location can be an intersection 116 between the parent wellbore 102 and the branch wellbore 114. The assembly 108 can be positioned using various techniques. Examples of positioning techniques include using a gyroscope and using an orienting profile.

Sleeve 112 is depicted as surrounding a circumferential portion of the casing string 116. Sleeves according to various embodiments can have any suitable configurations, including configurations that do not surround an entire circumferential portion of a casing string. For example, a sleeve may have a semi-circular cross-sectional shape. The semi-circular cross-sectional shaped sleeve can be positioned with respect to an opening of a casing string to provide desired performance, such as by cooperating with the casing string to provide a seal. In other embodiments, a sleeve can be wound multiple times around a circumferential portion of a casing string at a desired position with respect to an opening.

Branch wellbore 114 is depicted with dotted lines to indicate it has not yet formed. To form the branch wellbore 114, a whipstock or other tool can be positioned in the inner diameter of the casing string 106 relative to the opening 110 of the assembly 108. For example, keys or dogs associated with the whipstock can cooperatively engage an orienting profile to anchor the whipstock to the casing string 106 and to orient rotationally an inclined whipstock surface toward the opening 110.

Cutting tools, such as mills and/or drills, are lowered through the casing string 106 and deflected toward the opening 110. The cutting tools can drill through the sleeve 112 and the subterranean formation adjacent to the opening 110 to form the branch wellbore 114.

In some embodiments, the sleeve 112 is made from a material having a high specific strength and that can withstand pressures experienced in the subterranean environment, naturally present or introduced, prior to being drilled. The sleeve 112 may avoid substantially increasing the outer diameter of the assembly 108. The material can be relatively easy to drill such that milling through the sleeve 112 is not required. In some embodiments, sleeve 112 is made from two or more fiber materials. At least one of the fiber materials can have a relatively high specific strength. Examples of suitable fiber materials include carbon fiber, fiberglass, para-aramid synthetic fiber, silicon carbide, and carbon nanotubes. Although not depicted in FIG. 1, the assembly can also include an inner string and/or an inner sleeve to help provide support for the opening 110 and for the sleeve 112.

Figure 2:
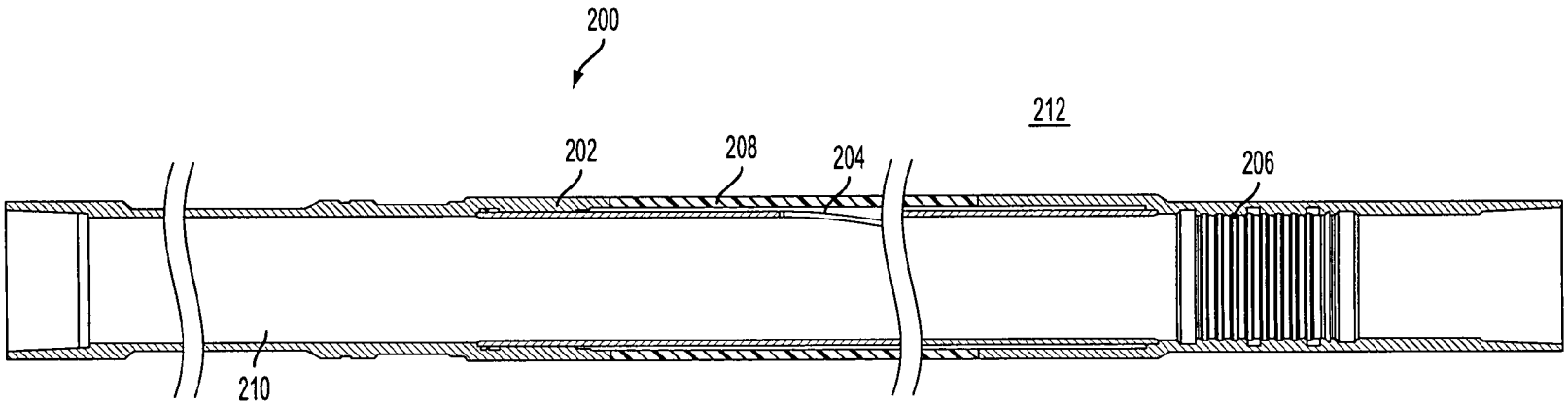
FIG. 2 is a cross-sectional view of an assembly having a sleeve exterior to a pre-milled window according to an embodiment of the present invention.

FIG. 2 depicts an assembly 200 according to one embodiment of the present invention that does not include an inner string or an inner sleeve. The assembly 200 includes a body 202 having an opening 204 in a sidewall of the body 202. The opening 204 can be a window formed prior to the assembly 200 being disposed in a wellbore. The assembly 200 includes a latch coupling 206 that can couple the assembly 200 to other tools, which together can be a casing string. The assembly 200 also includes a sleeve 208 exterior to the body 202. Part of the sleeve 208 is adjacent to the opening 204. The sleeve 208 can also cooperate with the body 202 to provide a pressure seal between an inner area 210 defined by the body 202 and an environment 212 exterior to the body.

The sleeve 208 can be configured to provide the pressure seal in view of burst and collapse pressures that may be present from the environment 212 or from the inner area 210. Some embodiments of the sleeve 208 can also provide the pressure seal in view of torsion or other forces. The body 202 can be configured to provide the pressure seal in view of axial loads. The sleeve 208 can cooperate with the body 202 to provide the pressure seal until the sleeve 208 is milled or drilled to form a branch wellbore. The sleeve 208 may be configured to be easily drilled and to not require milling to access the formation adjacent to the opening 204.

The sleeve 208 can be made from a material that is capable of withstanding the environment in the bore. For example, the material may be made from at least one fiber material and a support material, such as an epoxy. The material may have a high specific strength. In some embodiments, the material is a composite fiber that includes two or more fiber materials. For example, the sleeve 208 can be made from carbon fiber with fibers aligned to provide high strength in view of pressures experienced in a wellbore.

Figure 3:
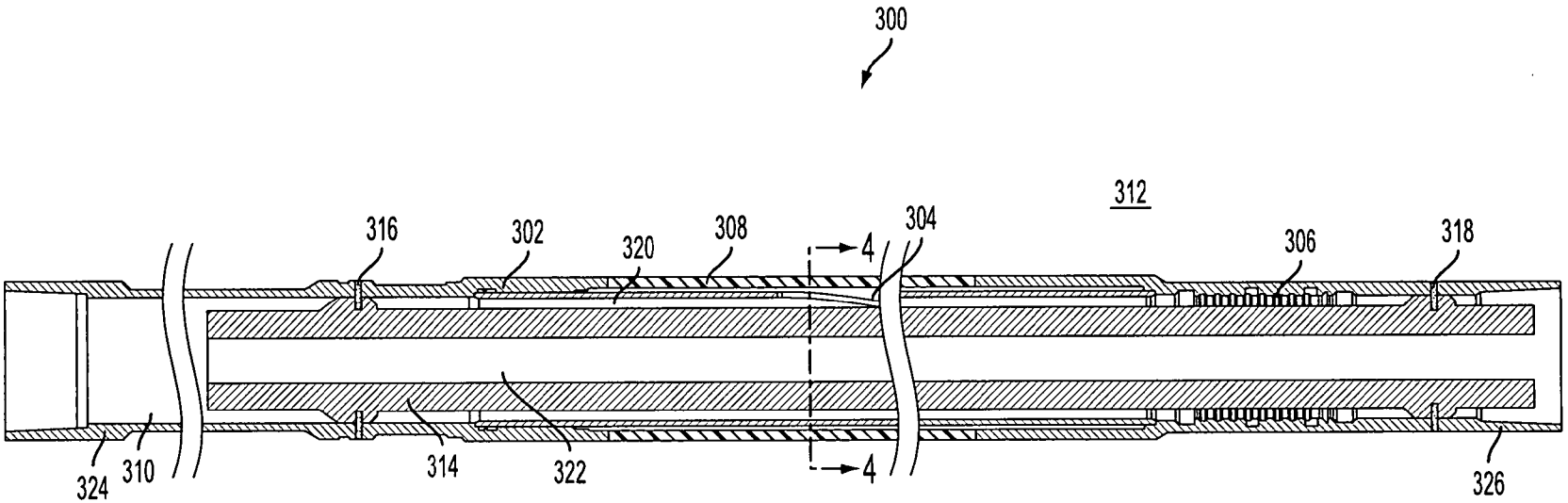
FIG. 3 is a cross-sectional view of an assembly having a sleeve exterior to a pre-milled window and a second sleeve located in an inner area of a casing string according to an embodiment of the present invention.

Assemblies according to various embodiments of the present invention can include components in addition to outer sleeves to relieve the outer sleeves of some of the pressures and/or forces that may be present in a subterranean environment. FIG. 3 depicts an assembly 300 that is in some ways similar to the assembly in FIG. 2. The assembly 300 includes a body 302 with an opening 304 that is a pre-milled window in a sidewall. A latch coupling 306 can couple the assembly 300 to other components of a casing string. A sleeve 308 is exterior to the body 302, with part of the sleeve 308 being adjacent to the opening 304. The sleeve 308 can cooperate with the body 302 to provide a pressure seal between an inner area 310 and an environment 312 exterior to the body 302. The sleeve 308 can be made from a material having a high specific strength, or otherwise a composite material.

The assembly 300 also includes an inner sleeve 314 that is disposed in the inner area 310. The inner sleeve 314 may be made from any material, including from the same or from a different material than that from which the sleeve 308 is made. Examples of materials from which inner sleeve 314 can be made include steel, aluminum, aluminum alloys, composite fiber, and fiberglass. The inner sleeve 314 can be coupled to the body 302 by connectors 316, 318. The inner sleeve 314 can define a region 320 internal to the inner sleeve. The inner sleeve 314, the sleeve 308, and part of the body 302 can define a second region 322.

The inner sleeve 314 can also cooperate with the body 302 (and optionally O-rings which are not shown) to provide a seal between the region 320 and the second region 322. In some embodiments, fluid can be located in the second region 322. The fluid may be an incompressible fluid such as hydraulic fluid. The seals may be floating seals that can change position because of burst pressure, or otherwise, and can apply the pressure to the fluid because of the position change.

The inner sleeve 314 can be configured to provide burst and collapse support to the sleeve 308 and to carry torsion forces from one end 324 of the assembly to a second end 326 of the assembly, and vice versa, to isolate the sleeve 308 from the torsion forces. In some embodiments, the inner sleeve 314 can hold tension forces to isolate the sleeve 308 from the tension forces.

For example, burst pressure, or other pressure, from the inner area 310 can affect the seal between the region 320 and the second region 322. For example, the burst pressure can cause floating seals to change position and cause the pressure to be exerted onto the fluid in the second region 322. The pressure in the second region 322 can match the pressure present in the region 320 to eliminate differential pressure on the inner sleeve. Floating seals changing position can also cause the fluid to exert pressure on the sleeve 308 at the opening 304. The pressure exerted on the sleeve 308 can eliminate differential pressure on the sleeve 308 from pressures, such as a collapse pressure, in the environment 312 exterior to the body 302. The fluid can also allow the inner sleeve 314 to hold differential pressure caused by pressure from the environment 312 exterior to the body 302 and translated through the sleeve 308.

After the assembly 300 is positioned in a wellbore, the sleeve 308 can be drilled or milled to allow a branch wellbore to be created. The inner sleeve 314 can be milled, drilled, or retrieved prior to or when the branch wellbore is created.

Figure 4:
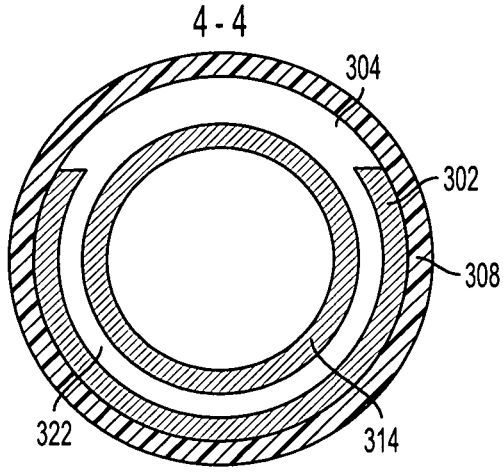
FIG. 4 is a cross-sectional view along line 4-4 of FIG. 3 according to an embodiment of the present invention.

FIG. 4 depicts a cross-sectional view of an embodiment of the assembly 300 along line 4-4. The sleeve 308 is exterior to the body 302 and at least part of the sleeve 308 is adjacent to the opening 304. The inner sleeve 314 is disposed in the inner area 310. The inner sleeve 314 can define the region 320 and the second region 322. Fluid (not illustrated) can be located in the second region 322.

Figure 5:
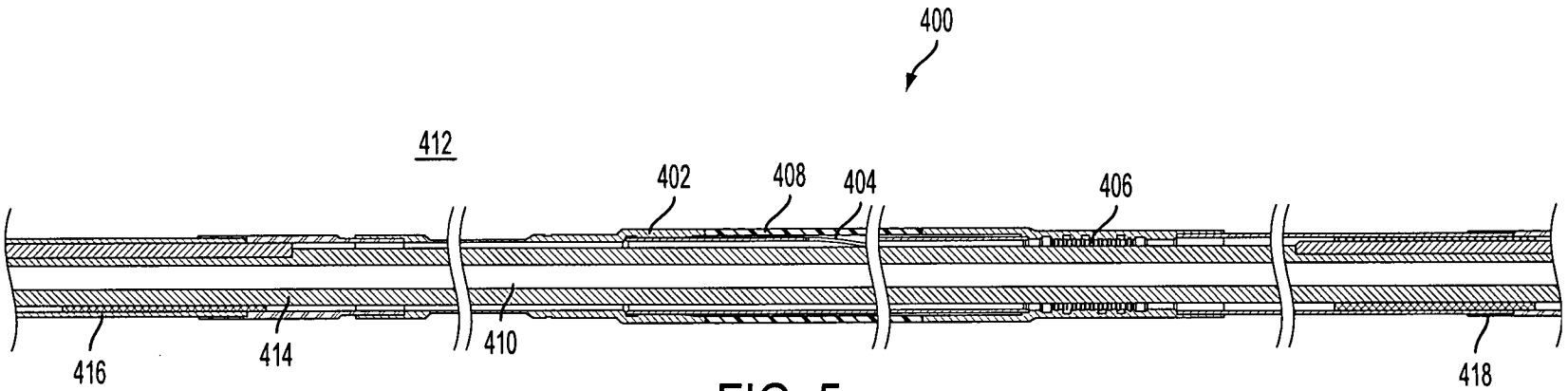
FIG. 5 is a cross-sectional view of an assembly having a sleeve exterior to a pre-milled window and a string located in an inner area of a casing string according to an embodiment of the present invention.

Assemblies according to some embodiments of the present invention can include strings disposed in an inner area of casing strings. The strings can be capable of isolating sleeves from one or more types of pressures or forces. FIG. 5 depicts a cross-sectional view of an embodiment of an assembly 400 that includes a body 402 with an opening 404 that is a pre-milled window in a sidewall. The assembly 400 includes a latch coupling 406 that can couple the assembly to other components of a casing string. A sleeve 408 is exterior to the body 402, with part of the sleeve 408 being adjacent to the opening 404. The sleeve 408 can cooperate with the body 402 to provide a pressure seal between an inner area 410 and an environment 412 exterior to the body 402. The sleeve 408 can be made from any material, such as a material having a high specific strength. Examples of such materials include carbon fiber, fiberglass, para-aramid synthetic fiber, silicon carbine, and carbon nanotubes.

The assembly 400 also includes a string 414 disposed in the inner area 410. The string 414 may be made from any material, including from the same or from a different material than that from which the sleeve 408 is made. Examples of materials from which string 414 can be made include steel, titanium, and aluminum alloys.

The string 414 can isolate the body 402 and sleeve 408 from tension and torsion forces by carrying such forces from one end 416 of the assembly 400 to a second end 418. The string 414 can be a permanent component of the assembly 400 disposed in the wellbore, or it can be retrievable after the assembly 400 is positioned.

Although FIGS. 3 and 5 depict assembly embodiments that include an inner sleeve or an inner string, but not both, certain assemblies according to embodiments of the present invention can include both an inner sleeve and an inner string.

Assemblies according to some embodiments can reduce the load required on a casing string and can minimize the outer diameter of the casing string with a pre-milled window. For example, a maximum outer diameter of a casing string with a pre-milled window may be 12.125 inches and the minimum outer diameter maybe 10.625 inches, providing 0.75 inches per side for a sleeve to be located to cover a pre-milled window. Sleeves made from a high specific strength material can reduce the thickness of the sleeves to allow the sleeves to cover the pre-milled windows and remaining in accordance with the diameter requirements. Furthermore, high specific strength sleeves, used in combination with inner sleeves or inner string strings, can reduce or eliminate a need for the sleeve to be thick to hold torsion forces. By isolating the torque into inner sleeves or inner strings, sleeves according to some embodiments only need to be thick enough to hold pressure (burst and collapse) and axial loads.

The foregoing description of the embodiments, including illustrated embodiments, of the invention has been presented for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. An assembly capable of being disposed in a bore, the assembly comprising:

a casing comprising a wall having a window in a portion thereof, the window being sized to receive a drill bit exiting the casing for creating a lateral wellbore;

a first sleeve disposed exterior to the casing, at least part of the first sleeve being adjacent to the window and being made from at least one fiber material and from a support material, wherein the first sleeve is configured to cooperate with the casing to provide a pressure seal between an inner area of the casing and an environment exterior to the casing;

a component configured for isolating the first sleeve from torque by carrying the torque from a first end of the assembly to a second end of the assembly; and a region between the first sleeve and the component, the region comprising fluid directly contacting a metal portion of the component.

2. The assembly of claim 1, wherein the component comprises a string disposed in the inner area of the casing, the string being configured to carry torque from the first end to the second end.

3. The assembly of claim 1, wherein the component comprises a second sleeve disposed in the inner area of the casing, the second sleeve being coupled to the casing, wherein the assembly further comprises:

the fluid disposed between at least part of the second sleeve and at least part of the first sleeve.

4. The assembly of claim 3, wherein the fluid is configured to cooperate with the first sleeve and the second sleeve to prevent bursting by the first sleeve.

5. The assembly of claim 3, wherein the fluid is an incompressible fluid.

6. The assembly of claim 1, wherein the at least one fiber material comprises at least one of:

carbon fiber;

fiberglass;

para-aramid synthetic fiber;

silicon carbide; or carbon nanotubes.

7. The assembly of claim 1, wherein the support material comprises an epoxy.

8. The assembly of claim 1, wherein at least part of the first sleeve adjacent to the window is capable of being drilled after being positioned in the bore.

9. An assembly capable of being disposed in a bore, the assembly comprising:

a casing comprising a wall having a window in a portion of the wall, the window being sized to receive a drill bit exiting the casing for creating a lateral wellbore;

a sleeve disposed exterior to the casing, at least part of the sleeve being adjacent to the window and being made from at least two different fiber materials, wherein the sleeve is configured to cooperate with the casing to provide a pressure seal between an inner area of the casing and an environment exterior to the casing;

a string disposed in the inner area of the casing, the string being configured to isolate the sleeve from torque by carrying the torque from a first end to a second end of the assembly; and a region between the sleeve and the string, the region comprising fluid directly contacting a metal portion of the string.

10. The assembly of claim 9, wherein the at least two different fiber materials comprise at least two of:

carbon fiber;

fiberglass;

para-aramid synthetic fiber;

silicon carbide; or carbon nanotubes.

11. The assembly of claim 9, wherein the sleeve is made from a support material comprising an epoxy.

12. The assembly of claim 9, wherein the metal comprises at least one of:

steel;

titanium alloy; or aluminum alloy.

13. The assembly of claim 9, wherein at least part of the sleeve adjacent to the window is capable of being drilled after being positioned in the bore.

14. An assembly capable of being disposed in a bore, the assembly comprising:

a casing comprising a wall having a window in a portion of the wall, the window being sized to receive a drill bit exiting the casing for creating a lateral wellbore;

a first sleeve disposed exterior to the casing, at least part of the first sleeve being adjacent to the window and being made from at least one fiber material, wherein the first sleeve is configured to cooperate with the casing to provide a pressure seal between an inner area of the casing and an environment exterior to the casing;

a second sleeve disposed in the inner area of the casing, the second sleeve being coupled to the casing, wherein the second sleeve is configured for isolating the first sleeve from torque by carrying the torque from a first end of the assembly to a second end of the assembly; and a region between the first sleeve and the second sleeve, the region comprising fluid directly contacting a metal portion of the second sleeve.

15. The assembly of claim 14, wherein the fluid is an incompressible fluid.

16. The assembly of claim 14, wherein the at least one fiber material comprises at least two different fiber materials comprising at least two of:

carbon fiber;

fiberglass;

para-aramid synthetic fiber;

silicon carbide; or carbon nanotubes.

17. The assembly of claim 14, wherein the second sleeve is coupled to the casing by connectors.

18. The assembly of claim 14, wherein the first sleeve is made from at least one support material comprising an epoxy.

19. The assembly of claim 14, wherein the fluid is configured to cooperate with the first sleeve and the second sleeve to prevent bursting by the first sleeve.

* * * * *